US006568158B2

(12) United States Patent
Shibazaki et al.

(10) Patent No.: US 6,568,158 B2
(45) Date of Patent: May 27, 2003

(54) BAND-APPLYING APPARATUS AND METHOD FOR USE IN PACKING SYSTEM

(75) Inventors: Tokio Shibazaki, Osaka (JP); Tadashi Meguro, Kawasaki (JP); Kenichi Enda, Yokohama (JP); Yoshikatsu Aizawa, Tokyo (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 09/907,037

(22) Filed: Jul. 17, 2001

(65) Prior Publication Data

US 2002/0026773 A1 Mar. 7, 2002

(30) Foreign Application Priority Data

Jul. 31, 2000 (JP) ..... 2000-230954

(51) Int. Cl.[7] ..... B65B 13/04; B65B 13/06; B65B 13/25

(52) U.S. Cl. ..... 53/582; 53/589; 100/29; 100/32

(58) Field of Search ..... 53/582, 589; 100/29, 100/32; 226/195, 35, 154, 155, 187; 242/419.5, 420.1, 419, 419.8

(56) References Cited

U.S. PATENT DOCUMENTS

| | | | | |
|---|---|---|---|---|
| 3,269,300 A | | 8/1966 | Billett et al. | |
| 3,847,071 A | * | 11/1974 | Goodley | 100/32 |
| 3,863,557 A | * | 2/1975 | Takahashi | 53/589 |
| 4,383,881 A | * | 5/1983 | Sakaki | 53/589 |
| 4,559,767 A | * | 12/1985 | Takami | 100/32 |
| 4,625,500 A | | 12/1986 | Huber | |
| 5,155,982 A | | 10/1992 | Boek et al. | |
| 5,170,612 A | * | 12/1992 | Sumino | 53/589 |
| 5,459,977 A | * | 10/1995 | Haberstroh | 53/589 |
| 6,041,698 A | * | 3/2000 | Chin-Chang et al. | 100/32 |

FOREIGN PATENT DOCUMENTS

| | | |
|---|---|---|
| GB | 1161827 A | 8/1969 |
| JP | 57-23611 B2 | 5/1982 |
| JP | 4-36928 B2 | 6/1992 |
| JP | 5-170217 A | 7/1993 |
| JP | 5-338615 A | 12/1993 |

* cited by examiner

*Primary Examiner*—Anthony D. Stashick
(74) *Attorney, Agent, or Firm*—Frishauf, Holtz, Goodman & Chick, P.C.

(57) ABSTRACT

A touch roller can be moved between three positions. In the first position, the touch roller is pressed onto a forward driving roller. In the second position, the touch roller is pressed onto a reverse driving roller with two different forces. In the third position, the touch roller is spaced from both the forward driving roller and the reverse driving roller. When the touch roller is pushed onto the reverse driving roller with a small force, the reverse driving roller pulls back a band and wraps the band around an article to be packed. When the touch roller is pushed onto the reverse driving roller with a large force, the reverse driving roller tightens the band wrapped around an article.

6 Claims, 5 Drawing Sheets

BAND-APPLYING APPARATUS AND METHOD FOR USE IN PACKING SYSTEM

BACKGROUND OF THE INVENTION

1. Field of the Invention

The present invention relates to a band-applying apparatus for use in a packing system, which comprises a plurality of roller units, each having a driving roller and a driven roller (touch roller), and in which a band is fed, pulled back and tightened, while being clamped between the driving roller of each roller unit and the driven roller pushed onto the driving roller. The invention also relates to a band-applying method for use in a packing apparatus.

2. Description of the Prior Art

Packing systems, so-called "band-wrapping packing systems," are known, each designed to pack an article by wrapping a band around the article and tying the ends of the band together. The band-wrapping packing system has a band-applying apparatus that comprises roller units, each including a driving roller and a driven roller. The driving roller of each roller unit feeds a band, pulls back the band, and tightens the band. The driven roller contacts the driving roller, clamping the band between it and the driving roller. The driving roller is rotated in the forward direction to feed the band reliably, while preventing the band from slipping on the driving roller. The driving roller is rotated in the reverse direction to pull the band back and tighten the same.

Japanese Patent Application KOKAI Publications Nos. 05-170217 and 05-338615, for example, disclose band-applying apparatuses for use in packing systems. Either apparatus has three roller units, each comprising a driving roller and a driven roller. The three roller units are designed to feed a band, pull it back and tighten it, respectively. The driving rollers of the roller units are a feed roller, a reverse roller or a tension roller. The feed roller feeds the band when it is driven in the forward direction. The reverse roller pulls back the band to wrap it around an article to be packed when it is driven in the reverse direction. The tension roller tightens the band when it is driven in the reverse direction.

Japanese Patent Application KOKOKU Publication No. 57-23611 discloses a band-applying apparatus for use in packing systems. This apparatus has two roller units, each comprising a driving roller and a driven roller. The first roller unit feeds a band and pulls it back. The second roller unit tightens the band. The driving roller (i.e., feed roller) of the first roller unit is rotated in the forward direction to feed the band and in the reverse direction to pull back the band. On the other hand, the driving roller (i.e., tension roller) of the second roller unit is rotated in the reverse direction to tighten the band. That is, the feed roller not only feeds the band, but also pulls back the band. In other words, the feed roller functions as a reverse roller, too.

Japanese Patent Application KOKOKU Publication No. 04-36928 discloses a band-applying apparatus for use in packing systems. This apparatus has two roller units, each comprising a driving roller and a driven roller. The driving roller of the first roller unit is a feed roller that rotates in the forward direction to feed the band. The driving roller of the second roller unit is a reverse roller that rotates in the reverse direction to pull back the band and tighten the same. That is, the reverse roller functions as a tension roller, too.

A driven roller (i.e., tough roller) usually comprises a roller body, a bearing such as a ball bearing, and is supported on a support member such as a support arm. A driving member such as a solenoid or a cam rotates the support member.

The band-applying apparatuses disclosed in Japanese Patent Application KOKAI Publications Nos. 05-170217 and 05-338615 have three rollers units, each comprising a driver roller and a driven roller. Having many components, they are complex in structure. Nevertheless, the three driving rollers (i.e. feed roller, reverse roller, and tension roller) need not be rotated in both the forward direction and the reverse direction. They need to rotate in one direction only. More specifically, the driving roller (i.e., feed roller) for feeding the band is driven in the forward direction only, and the roller (i.e., reverse roller) for pulling back the band and the roller (i.e., tension roller) for tightening the band are driven in the reverse direction only. Thus, the motor and the reduction-gear mechanism can be small and simple.

The band-applying apparatus disclosed in Japanese Patent Application KOKOKU Publication No. 57-23611 has two roller units, each comprising a driving roller and a driven roller. The driving roller (i.e., feed roller) of the first roller unit is rotated in the forward direction to feed the band and in the reverse direction to pull back the band. Thus, the feed roller functions as a reverse roller, too. The apparatus is therefore simpler than otherwise. However, the feed roller must be driven in the forward direction to feed the band and in the reverse direction to pull back the band. Inevitably, the motor and the reduction-gear mechanism are large and complex in structure. Japanese Patent Application KOKOKU Publication No. 57-23611 further discloses another band-applying apparatus in which one touch roller is attached to one end of a support arm and is pushed onto the feed roller or the tension roller by rotating the support arm. In this apparatus, the same touch roller can contact the feed roller and the tension roller. This helps to simplify the structure.

The band-applying apparatus disclosed in Japanese Patent Application KOKOKU Publication No. 04-36928 has two roller units, each comprising a driving roller and a driven roller. The reverse driving roller functions not only as a reverse roller, but also as a tension roller. Therefore, the apparatus has a simple structure. The driven roller can be driven. The reverse roller (i.e., driving roller) is driven to pull back the band, and the driven roller (i.e., touch roller) of the reverse roller is driven to tighten the band. That is, the driven roller is pushed onto the driving roller, clamping the band between it and the driving roller, when the band is pulled back and when the band is tightened. To pull back the band, the driven roller of the reverse roller is driven and the driving roller is not driven. To tighten the band, the driven roller of the reverse roller is not driven and the driving roller is driven. The driven roller is pushed to the driving roller with a greater force to tighten the band, than in the process of pulling back the band.

In this apparatus, in which the driven roller of the reverse roller is driven, the driven roller is complicated in structure. Further, one roller (i.e., reverse roller) must be driven to pull back the band, and another roller (i.e., touch roller) must be driven to tighten the band. In view of this, too, the apparatus is complex in structure.

SUMMARY OF THE INVENTION

An object of the present invention is to provide a band-applying apparatus for use in a packing system, which comprises a small number of components and has therefore a simple structure and which has a small and simple reduction-gear mechanism. Another object of the invention is to provide a band-applying method for use in a packing system.

To achieve the first-mentioned object, there is provided a band-applying apparatus in which a single touch roller is first pushed onto a forward driving roller and then onto a reverse driving roller with two different forces.

More precisely, the touch roller is pushed onto the reverse driving roller with a small force, with a band clamped between it and the reverse driving roller, thereby to pull back the band and wrap the band around an article to be packed. Then, the touch roller is pushed onto the reverse driving roller with a large force, thereby to tighten the band wrapped around the article. Thus, the reverse driving roller functions not only as a reverse roller, but also as a tension roller.

In a band-applying method according to the present invention, a single touch roller works together with both a forward driving roller and a reverse driving roller. The touch roller is first pushed onto the forward driving roller and then onto the reverse driving roller with a small force or with a large force. Hence, the same touch roller serves to feed a band forward, pull it back and tighten it. In other words, the band can be fed, pulled back and tightened, merely by moving the touch roller between the forward driving roller and the reverse roller and controlling the force with which the touch roller is pushed onto the reverse driving roller.

DETAILED DESCRIPTION OF THE PREFERRED EMBODIMENTS

An embodiment of the present invention will be described in detail, with reference to the accompanying drawings.

Figure 1B:
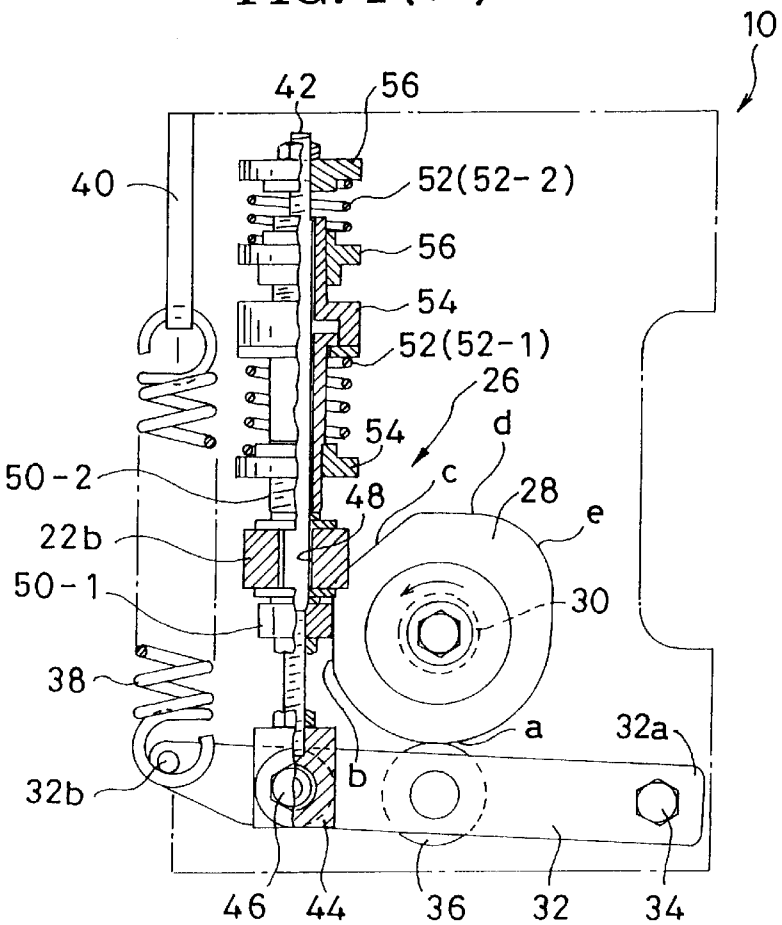
FIG. 1(B) is a partly sectional left-side view of a band-applying apparatus, showing the touch roller remaining in the neutral position.
Figure 1A:
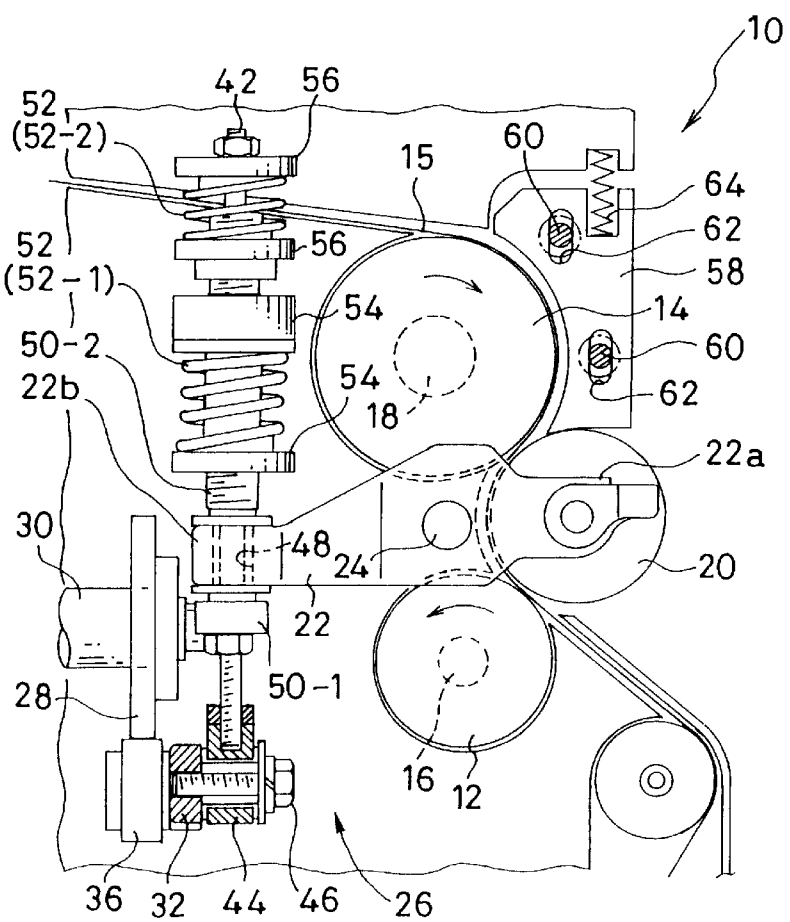
FIG. 1(A) is a partly sectional front view of a band-applying apparatus according to the present invention, showing the touch roller remaining in the neutral position.

As FIGS. 1(A) and 1(B) show, the band-applying apparatus 10 according to the invention, which is designed for use in a packing system, comprises a forward driving roller 12 and a reverse driving roller 14. Assume that the packing system is a band-wrapping packing system. When the forward driving roller 12 is driven, a band 15 is fed, with its distal end guided in a specified direction, or toward the band-applying port. When the reverse driving roller 14 is driven, the band 15 is pulled back to wrap around the article to be packed and tightened.

As in the band-applying apparatus disclosed in, for example, Japanese Patent Application KOKAI Publication No. 05-170217, the forward driving roller 12 and the reverse driving roller 14 are formed integral with two shafts 16 and 18, respectively, and can freely rotate. Two pulleys are mounted on the shafts 16 and 18, respectively. Two motors (not shown) are provided, one to drive the forward driving roller 12 and the other to drive the reverse driving roller 14. A drive belt (not shown) is wrapped around one motor and the pulley mounted on the shaft 16. Another drive belt (not shown, either) is wrapped around the other motor and the pulley mounted on the shaft 18.

The band-applying apparatus 10 comprising the forward driving roller 12 and the reverse driving roller 14 is similar in basic structure, basic operation and the like to the band-applying apparatuses disclosed in Japanese Patent Application KOKAI Publications Nos. 05-170217 and 05-338615, and Japanese Patent Application. KOKOKU Publication 57-23611. Neither the basic structure nor the basic operation is the essence of the present invention. Therefore, they will not be described in detail.

As seen from FIG. 1(A), the forward driving roller 12 and the reverse driving roller 14 are spaced apart and located one above the other. More precisely, the reverse driving roller 14 is provided above the forward driving roller 12. A touch roller 20, which is a free-rotating driven roller, is provided. The touch roller 20 can take three positions. In the first position, it is pushed onto the forward driving roller 12. In the second position, it is pushed onto the reverse driving roller 14. In the third position, it is spaced from both the forward driving roller 12 and the reverse driving roller 14.

The touch roller (i.e., driven roller) 20 is rotatably mounted on one end 22*a*, or free-end of a support arm 22. The support arm 22 is located between the forward driving roller 12 and the reverse driving roller 14 and held, like a seesaw, on an axle 24. As the support arm 22 rotates around the axle 24, the touch roller 20 moves to the first position shown in FIG. 2(A), where it is pushed onto the forward driving roller 12, or to the second position shown in FIG. 4(A), where it is pushed onto the reverse driving roller 14.

In the present invention, the single touch roller 20 is a driven roller common to the forward driving roller 12 and the reverse driving roller 14. That is, the roller 20 can work together with both driving rollers 12 and 14.

The band-applying apparatus 10 comprises a changeover mechanism 26 coupled to the other end, or proximal end 22*b* of the support arm 22. The changeover mechanism 26 rotates the support arm 22, thereby to move the touch roller 20 between the first position and the second position.

As can be understood from FIGS. 1(A) and 1(B), the changeover mechanism 26 has a cam 28 that can be rotated. The cam 28 is mounted on a camshaft 30 of the sealing unit (not shown) incorporated in the packing system. The sealing unit is designed to hold the distal end of the band 15, adhere the ends of the band together, and cut the band. The cam 28 is rotated as the camshaft 30 rotates. Thus, as the sealing unit operates, the cam 28 rotates, rotating the support arm 22 and moving the touch roller 20 between the first position and the second position. As a result of this, the band 15 is fed, pulled back and tightened, both easily and reliably. No other components than the camshaft 30 are necessary for rotating the cam 28. A swing arm 32 is supported at one end 32*a* by a pivotal pin 34 and provided below the cam 28. As the cam 28 rotates, the swing arm 32 is rotated around the pivotal pin 34.

As FIG. 1(B) shows, the swing arm 32 has a cam roller 36, which is located to contact the cam 28. A cam support spring 38 biases the swing arm 32 toward the cam 28. The swing arm 32 is reliably rotated as the cam 28 rotates in contact with the cam roller 36.

The cam support spring 38 is, for example, an expansion coil spring that is connected at one end to the free end 32*b* of the swing arm 32 and at the other end to an engagement strip 40. Note that the strip 40 is held in position above the free end 32*b* of the swing arm 32. The cam support spring 38 keeps biasing the cam roller 36 onto the cam 28. Hence, the swing arm 32 can rotate, following the change in the position of the cam 28, as seen from FIGS. 1(B), 2(B) and 4(B).

As illustrated in FIGS. 1(A) and 1(B), the changeover mechanism 26 has a support rod 42, a coupler 44, a bolt 46, and a pair of pushing members 50-1 and 50-2. The support rod 42 is provided to transmit the rotation of the swing arm 32 to the proximal end 22*b* of the support arm 22. The coupler 44 and a bolt 46 couple one end of the support rod 42 to the swing arm 32. The support rod 42 is loosely inserted in the through hole made in the proximal end 22*b* of the support arm 22. The pushing members 50-1 and 50-2, which can contact the proximal end 22*b*, are mounted on the support rod 42, positioned below and above the proximal end 22*b*, respectively. Thus, the pushing members 50-1 and 50-2 can transmit the motion of the support rod 42 to the proximal end 22*b* of the support arm 22. It should be noted that the motion of the support rod 42 follows the rotation of the swing arm 32.

In the embodiment of the invention, the pushing member 50-1, which is located below the proximal end 22*b* of the support arm 22, serves to push the touch roller 20 onto the forward driving roller 12. On the other hand, the pushing member 50-2, which is located above the proximal end 22*b*, serves to push the touch roller 20 onto the reverse driving roller 14.

When the swing arm 32 rotates as the cam 28 is rotated, the changeover mechanism 26 moves the support rod 42 up and down, rotating the support arm 22. Thus rotated, the support arm 22 pushes the touch roller 20 onto either the forward driving roller 12 (see FIG. 2(A)) or the reverse driving roller 14 (see FIG. 4(A) or 5(A)).

Figure 3B:
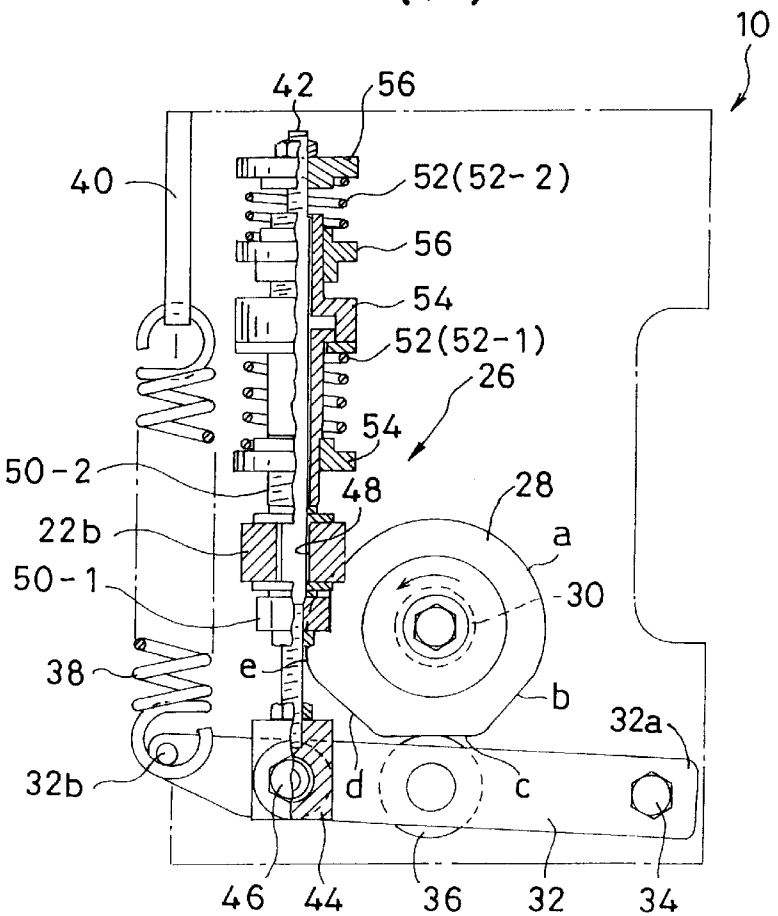
FIG. 3(B) is a partly sectional left-side view of the band-applying apparatus, which stays in the stand-by state (initial state)
Figure 3A:
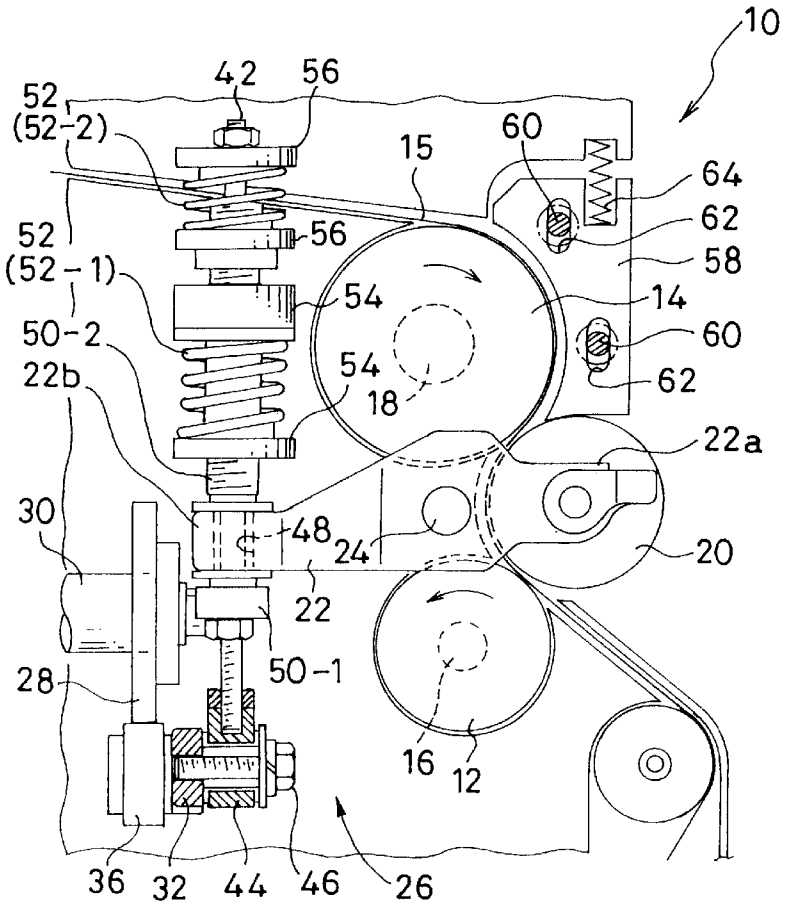
FIG. 3(A) is a partly sectional front view of the band-applying apparatus, which stays in the stand-by state (initial state)

The cam 28 may hold the touch roller 20 in the third position, instead of the first position where the roller 20 contacts the forward driving roller 12 or the second position where the roller 20 contacts the reverse driving roller 14. In the third position, the touch roller 20 contacts neither the forward driving roller 12 nor the reverse driving roller 14, as is illustrated in FIGS. 1(A) and 3(A).

How the band-applying apparatus 10 operates will be explained below.

In the initial state, the band-applying apparatus 10 feeds a length of the band 15. Then, the band-applying apparatus 10 pulls the band 15 back to wrap around an article to be packed and tightens the band. Thereafter, the apparatus 10 takes the initial state again, to feed a length of the band 15. The packing process therefore consists of three steps of feeding a band, pulling back the band, and tightening the band.

The step of feeding the band 15 will be first described. After the band 15 previously fed and wrapped around the article has been tightened, the camshaft 30 of the sealing unit is rotated. The cam 28 is thereby rotated, rotating the swing arm 32 and moves the touch roller 20 to the third position, or the neutral position. In the neutral position, the cam 28 takes a cam position (a) (FIG. 1(B)). The cam 28 further rotates and takes a cam position (b) (FIG. 2(B)). Then, the swing arm 32 is rotated with its free end 32*b* rising, due to the bias of the cam support spring 38. The pushing member 50-1 pushes up the free end 22*b* of the support arm 22. The support arm 22 is thereby rotated clockwise around the axle 24. As the support arm 22 is so rotated, the touch roller 20 moves down to the first position and is pushed onto the forward driving roller 12.

The forward driving roller 12 is rotated in the forward direction, while the touch roller 20 remains pushed onto it. The band 15 is thereby fed forward for a length equal to the distance the circumference of the roller 12 moves. At this time, the cam 28 takes a cam position (c) shown in FIG. 3(B) since the camshaft 30 has rotated. Thus, the touch roller 20 takes its neutral position. The band-applying apparatus 10 assumes the standby state and is made ready to perform the next step of packing the article.

While the apparatus 10 stays in the stand-by state (i.e., cam position (c)), the band 15 is wrapped around the article if it is, for example, a semi-automatic one. Thereafter, when the distal end of the band 15 is detected in the band-applying port (not shown), the camshaft 30 is rotated, rotating the cam 28 toward a cam position (d) shown in FIG. 4(B). When the cam 28 starts rotating toward the cam position (d), the band-applying apparatus 10 is actuated.

Figure 4B:
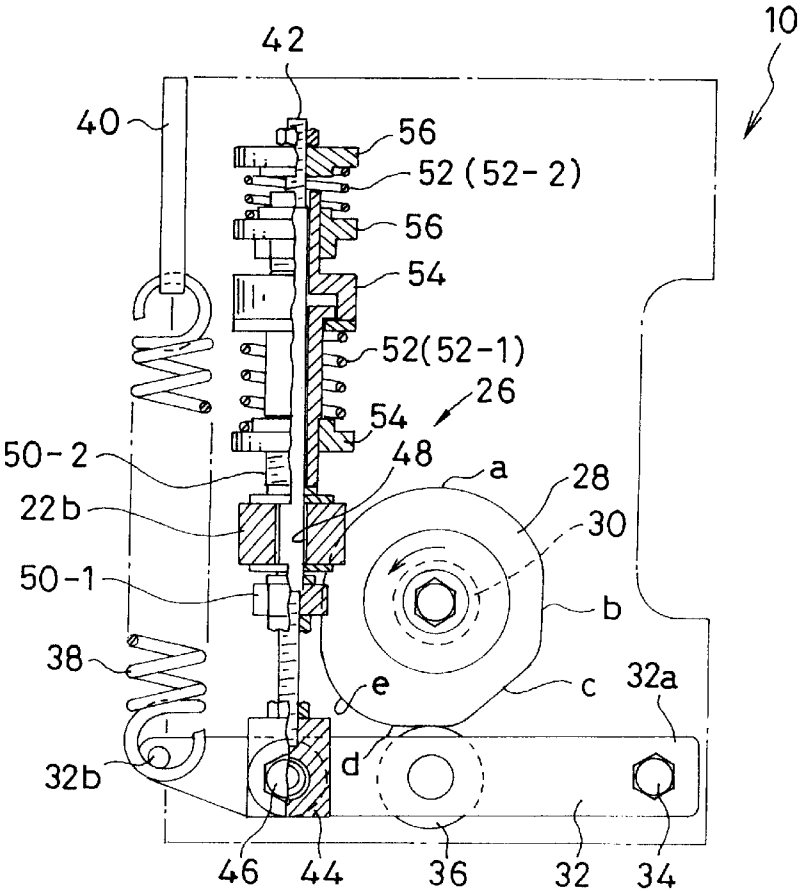
FIG. 4(B) is a partly sectional left-side view of the band-applying apparatus, showing the band being pulled back.
Figure 4A:
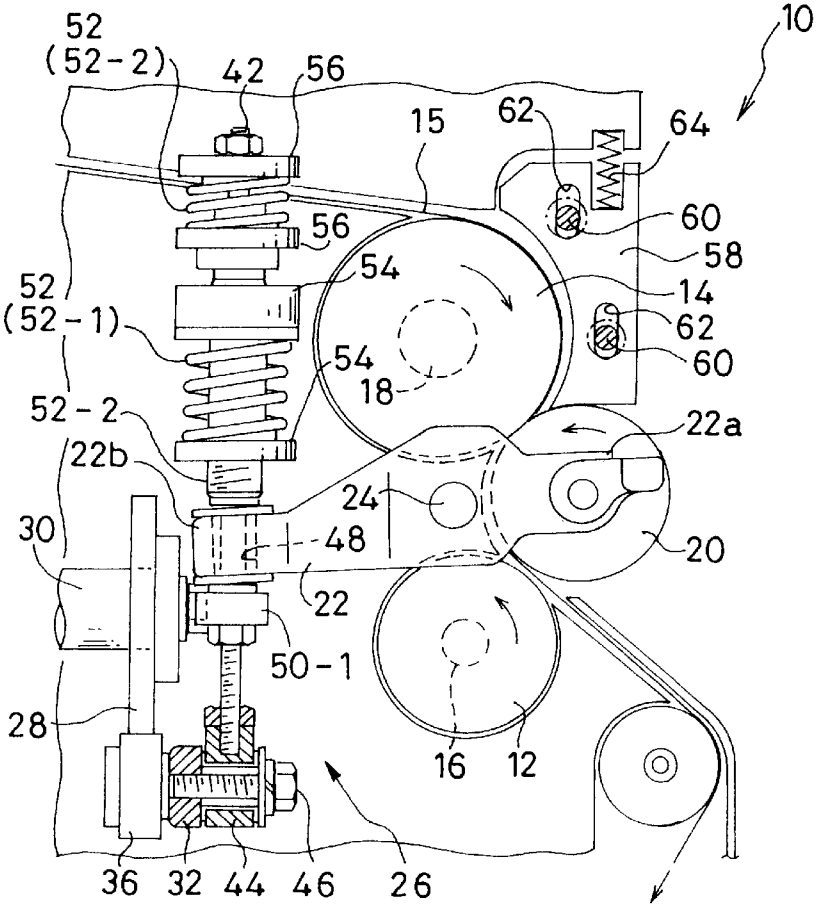
FIG. 4(A) is a partly sectional front view of the band-applying apparatus, showing a band being pulled back.

When the cam 28 reaches the cam position (d), the swing arm 32 rotates against the bias of the cam support spring 38, with its free end 32*b* moving downwards as is illustrated in FIG. 4(B).

The support rod 42 coupled to the free end 32*b* of the swing arm 32 is therefore pulled down. The pushing member 50-2 mounted on the support rod 42 pushes the proximal end 22*b* of the support arm 22. The support arm 22 is rotated counterclockwise. Coupled to the distal end 22*a* of the support arm 22, the touch roller 20 is moved upwards until it is pushed onto the reverse driving roller 14.

Now that the touch roller 20 contacts the reverse driving roller 14, the band 15 clamped between the touch roller 20 and the reverse driving roller 14 is pulled back. Since that part of the band 15 fed forward is longer than is necessary to wrap the article tightly, the band is pulled back for a distance equal to the length of the excessive part of band fed forward. Hence, the band 15 wrapped around the article is no longer loose.

As indicated above, the single touch roller 20 is a driven roller common to the forward driving roller 12 and the reverse driving roller 14. Two touch rollers are not necessary for the rollers 12 and 14, respectively, as in the conventional band-applying apparatuses. The band-applying apparatus 10 has fewer components than the conventional ones. Thus, the apparatus 10 is simpler in structure than the conventional band-applying apparatuses.

In the present invention, the single touch roller 20 is coupled to the support arm 22 that can freely rotate and the changeover mechanism 26 can change the inclination (rotation) of the support arm 22. This enables the touch roller 20 to work together with both the forward driving roller 12 and the reverse driving roller 14.

When the reverse driving roller 14 is rotated in the reverse direction, the band 15 is pulled back and tightened. It is therefore unnecessary for the touch roller 20 to drive anything else at all. The touch roller 20 can be an ordinary one that rotates freely; it need not be complex in structure.

In the embodiment of the invention, the swing arm 32 can swing as the cam 28 rotates, because the cam roller 36 contacts the cam 28. Nonetheless, the cam roller 36 can be dispensed with. If this is the case, it suffices to set the swing arm 32 in direct abutment with the cam 28.

Since the cam roller 36 that can freely rotate contacts the cam 28, the cam can smoothly rotate no matter how the swing arm 32 swings. This makes the camshaft 30 rotate smoothly. The embodiment can therefore operate with no troubles.

As mentioned above, the cam support spring 38 is an expansion coil spring connected at one end to the free end 32*b* of 10 the swing arm 32. The spring 38 need only apply a bias to the swing arm 32, causing the swing arm to swing as the cam 28 rotates. In view of this, the spring 38 need not be limited to an expansion coil spring. Rather, it may be another type of a spring, such as a compression coil spring or a twisted spring.

In the embodiment, the support arm 22 can rotate like a seesaw and the cam 28 rotates to control the changeover mechanism 26. Nevertheless, the support arm 22 need only push the touch roller 20 onto either the forward driving roller 12 or the reverse driving roller 14. The changeover mechanism 26 may be replaced by any other type that the cam 28 rotates the support arm 22 to change the inclination of the support arm 22. For example, the touch roller 20 may be rotatably coupled to the free end of a support arm that rotates around its one end. Alternatively, a drive means such as a solenoid may be used in place of the changeover mechanism 26.

The single touch roller 20 is mounted on the free end 22*a* of the support arm 22 that can rotate like a seesaw in the embodiment of the invention. Additionally, the changeover mechanism 26 including the cam 28 changes the inclination of the support arm 22. The force with which the touch roller 20 is pushed onto the roller 12 or 14 can be easily adjusted in the embodiment of the invention.

To be more specific, the pushing member 50-2, which serves to push the touch roller 20 onto the reverse driving roller 14, can slide in the axis of the support rod 42. A force-adjusting spring 52 is mounted on the support rod 42. The spring 52 applies its force to the pushing member 50-2, biasing the pushing member 50-2 downwards. This makes it easy to vary the force that pushes the touch roller 20 onto the reverse driving roller 14 in accordance with the position of the cam 28.

The force-adjusting spring 52 is a combination of two coil springs 52-1 and 52-2, both loosely wound around the support rod 42, as is illustrated in FIGS. 1(A) and 1(B). A pair of ring-shaped supports 54 are mounted on the support rod 42, sandwiching the coil spring 52-1. Another pair of ring-shaped supports 56 are mounted on the support rod 42, sandwiching the coil spring 52-2. Thus, force-adjusting spring 52 applies a bias to the pushing member 50-2 through the supports 54 and the supports 56.

Figure 5B:
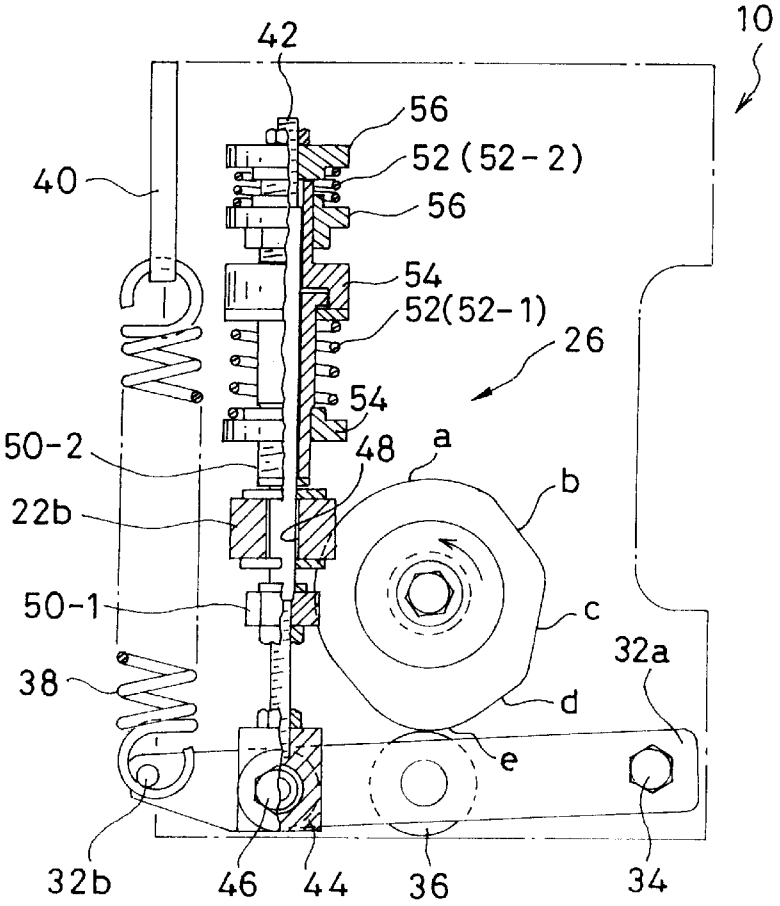
FIG. 5(B) is a partly sectional left-side view of the band-applying apparatus, showing the band being tightened.
Figure 5A:
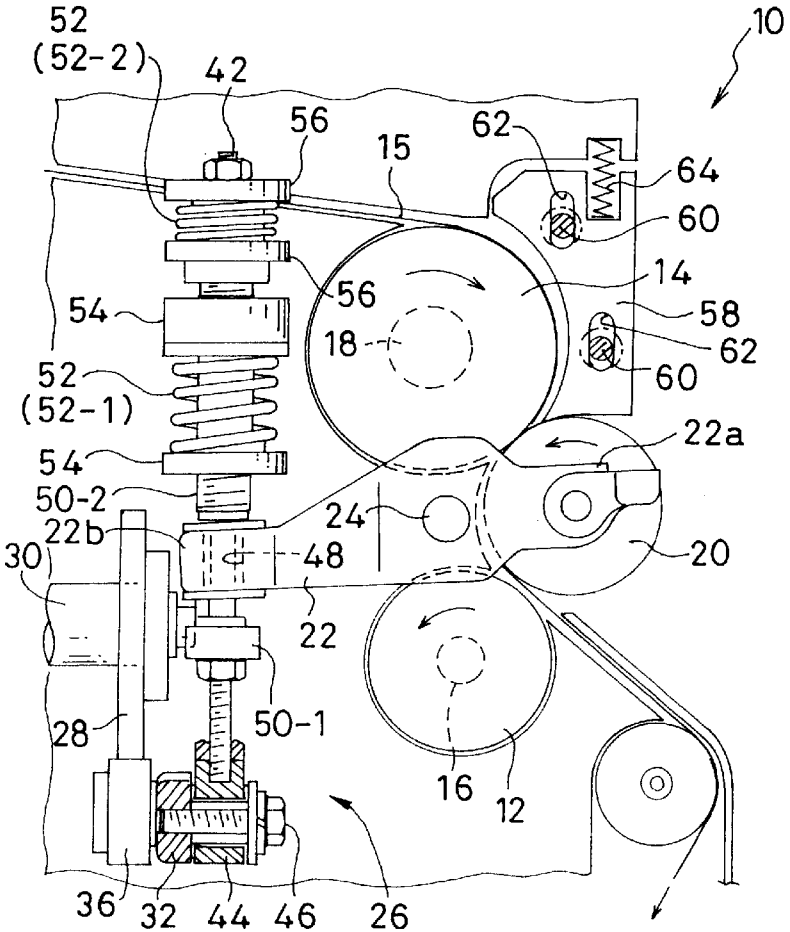
FIG. 5(A) is a partly sectional front view of the band-applying apparatus, showing a band being tightened.

When the camshaft 30 is rotated, further rotating the cam 28 to a cam position (e) from the cam position (d), as is illustrated in FIG. 5(B). The swing arm 32 further rotates counterclockwise against the bias of the cam support spring 38. The support rod 42 therefore moves to a lower position than in the step of pulling back the band 15. That is, the support rod 42 moves down for a longer distance than is necessary to bring the touch roller 20 into contact with the reverse driving roller 14. As a result, the pushing member 50-2 that moves down as the rod 42 moves downwards, rotating the support arm 22 counterclockwise.

As the support rod 42 moves down, compressing the force-adjusting spring 52 (i.e., springs 52-1 and 52-2). So compressed, the spring 52 exerts a bias on the support arm 22, which further rotates counterclockwise. The touch roller 20 is pushed onto the reverse driving roller 14 more strongly. The band 15 is therefore clamped between the reverse driving roller 14 and the touch roller 20, more firmly than when it is pulled back. That is, the reverse driving roller 14 attains a greater torque while the cam 28 remains at the cam position (e) than while the cam stays at the cam position (d).

Thus, the torque can be switched from one for pulling back the band 15 to one for tightening the band by changing only the position of the cam 28. When the touch roller 20 is strongly pushed onto the reverse driving roller 14, the roller 14 functions as a tension roller, too, tightening the band 15. Namely, the reverse driving roller 14 functions as a reverse roller to pull back the band 15 when the touch roller 20 is lightly pushed onto the roller 14, and as a tension roller to tighten the band 15 when the touch roller 20 is strongly pushed onto the roller 14.

According to this invention, the reverse driving roller 14 works as both a reverse roller and a tension roller. A tension roller need not be provided exclusively for tightening the band 15. It is not necessary to provide a touch roller for the tension roller only. This reduces the number of components, ultimately simplifying the structure of the band-applying apparatus 10.

When the support arm 22 is rotated in one direction, the touch roller 20 is pushed onto the forward driving roller 12, thereby feeding the band 15 forward. When the support arm 22 is rotated in the opposite direction, the touch roller 20 is pushed onto the reverse driving roller 14, thereby pulling back the band 15. When the support arm 22 is further rotated in the opposite direction, the touch roller 20 is strongly pushed onto the reverse driving roller 14, thereby tightening the band 15. Thus, it is possible to feed, pull back and tighten the band 15, only by controlling one touch roller 20. In other words, the band 15 can be fed, pulled back and tightened by means of a control mechanism of simple structure.

Figure 2B:
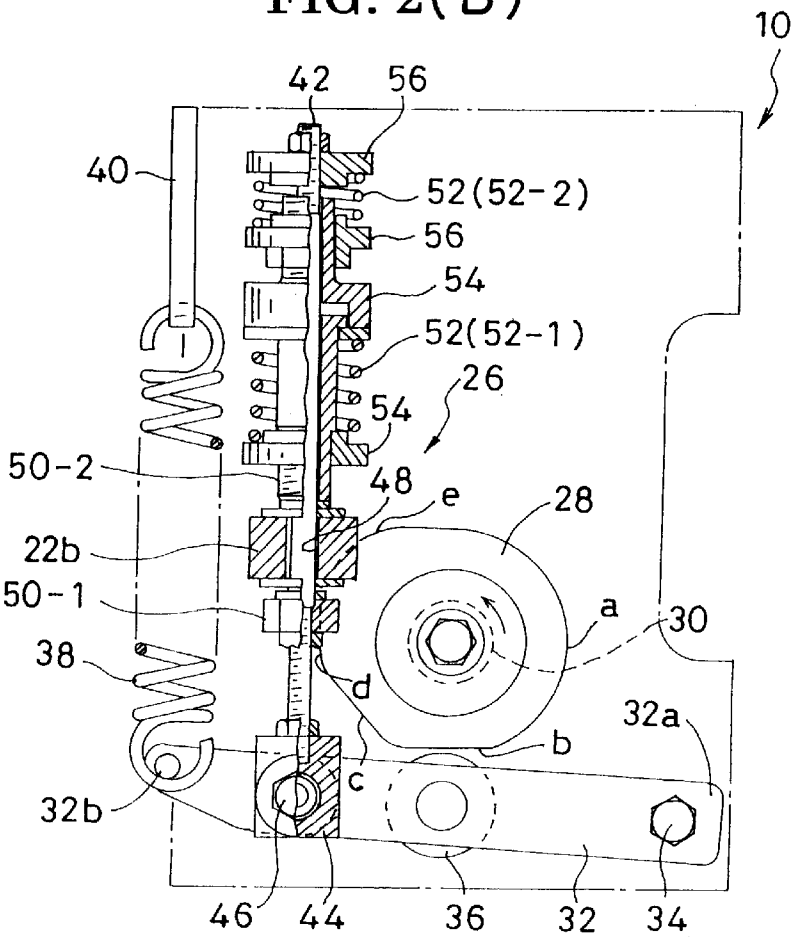
FIG. 2(B) is a partly sectional left-side view of the band-applying apparatus, showing the band being fed forward.
Figure 2A:
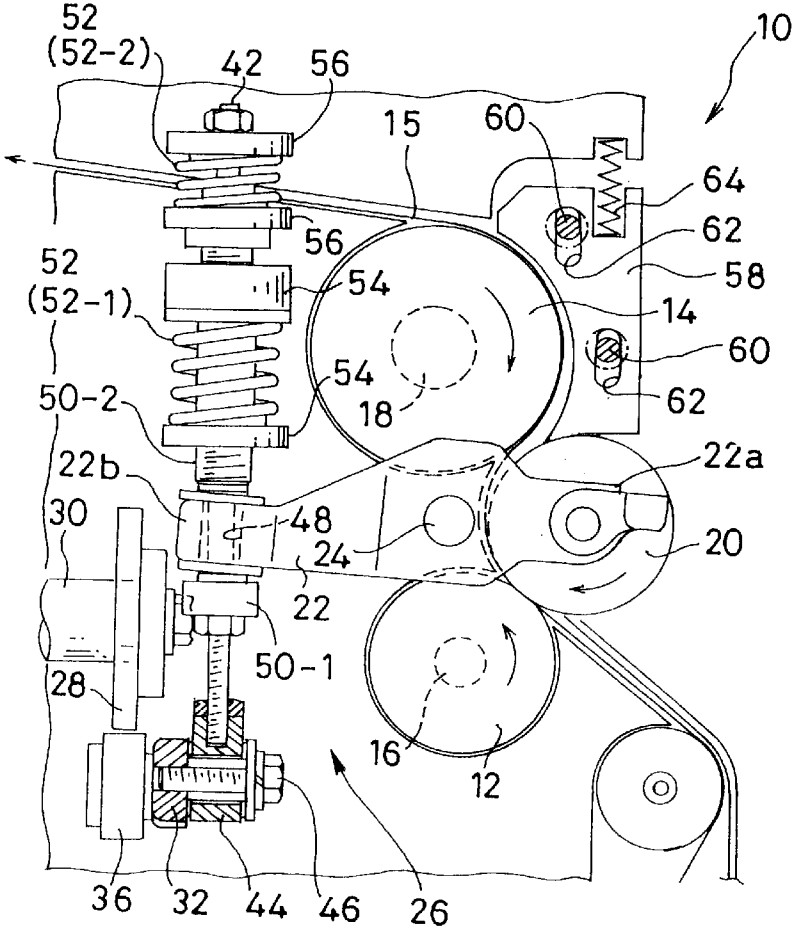
FIG. 2(A) is a partly sectional front view of the band-applying apparatus, showing a band being fed forward.

After the band 15 is tightened when the cam 28 is set at the cam position (e) as shown in FIG. 5(B), the cam 28 is further rotated to the cam position (a) (FIG. 1(B)) and then to the cam position (b) (FIG. 2(B)). While the cam 28 remains at the cam position (b), the band 15 is fed forward. Thereafter, the cam 28 is rotated to the cam position (c). The cam 28 stays at the cam position (c) until the packing system starts the next packing process.

As seen from FIG. 1(A), a band guide 58, generally known as "band shooter," is provided near the touch roller 20. The band shooter 58 can be moved up and down as the touch roller 20 is moved.

The band shooter 58 has two elongated holes 62. Two pins 60 are loosely inserted in the elongated holes 62, respectively. Supported by the pins 60, the band shooter 58 moves up and down as the touch roller 20 is moved, thanks to the bias it receives from a spring 64. The spring 64 is, for example, a compression coil spring.

As FIGS. 1(A) to 5(A) show, no gap exists between the touch roller 20 and the band shooter 58, whichever position the touch roller 20 takes. The distal end of the band 15 would not be clamped between the touch roller 20 and the band shooter 58 to cause any trouble. Since no gap is provided between the touch roller 20 and the band shooter 58, the position of the band shooter 58 need not be precisely positioned with respect to the touch roller 20. The band-applying apparatus 10 can therefore be assembled easily and assembled again after it is overhauled for maintenance.

The band shooter 58 is not limited to the one shown in FIGS. 1(A) to 5(A). Rather, any other type that can be incorporated in the band-applying apparatus 10 may be used instead.

In the embodiment described above, the reverse driving roller 14 is positioned above the forward driving roller 12. Nonetheless, the forward driving roller 12 and the reverse driving roller 14 may be spaced side by side. If this is the case, the support arm 22 vertically extends and is rotated to move the touch roller 20 from the left to the right and vice versa, and the swing arm 32 vertically extends and is rotated to move the proximal end 22*b* of the support arm 22 from left to the right and vice versa.

The embodiment is designed for use in semi-automatic packing systems. Nevertheless, the present invention can be applied to a full-automatic packing system that comprises an arch shaped like ⊓ and having a band way. In the full-automatic packing system, a band is fed forward along the guide way and then pulled back, whereby the band falls from the band way and is wrapped around an article to be packed.

The present invention has been described, with reference to an embodiment. The invention is not limited to the embodiment, nonetheless. Various changes and modification can be made within the scope and spirit of the present invention.

As has been described, the band-applying apparatus according to the invention has only one touch roller that works jointly with both the forward driving roller and the reverse driving roller. Since no other touch rollers need to be used, the apparatus comprises a relatively small number of components and has a simple structure.

Only one touch roller needs to be coupled to a support arm that can rotate freely, and the changeover mechanism can change the inclination of the support arm. The touch roller can therefore be pushed onto the forward driving roller and the reverse driving roller.

The reverse driving roller is driven to pull back the band or tighten the band. The touch roller need not drive anything else. Therefore, the touch roller can be an ordinary one that rotates freely.

The single touch roller is coupled to the free end of the support arm that can rotate like a seesaw. The inclination of the support arm is changed when the support arm is rotated by the changeover mechanism having a cam. Thus, if the position of the cam is changed, it is possible to adjust the force with which the touch roller is pushed onto the reverse driving roller. The touch roller can be pushed onto the reverse driving roller with either a small force or a large force. Hence, the reverse driving roller can function as both a reverse roller and a tension roller, to pull back the band and tighten the band.

Moreover, the present invention provides a band-applying method for use in a packing system. In this method, a touch roller can work together with both a forward driving roller and a reverse driving roller. If the touch roller is pushed onto the forward driving roller, a band can be fed forward. If the touch roller is lightly pushed onto the reverse driving roller, the band can be pulled back. If the touch roller is strongly pushed onto the reverse driving roller, the band can be tightened. Thus, the band can be fed, pulled back and tightened, merely by moving the touch roller between the forward driving roller and the reverse roller and controlling the force with which the touch roller is pushed onto the reverse driving roller.

What is claimed is:

1. A band-applying apparatus for use in a packing system, said band-applying apparatus comprising:

a forward driving roller configured to rotate in a first direction to feed a band in a prescribed direction;

a reverse driving roller spaced apart from the forward driving roller and configured to rotate in a second direction opposite to the first direction;

a support arm configured to be rotated;

a changeover mechanism for rotating the support arm to change an inclination of the support arm; and a touch roller mounted on a free end of the support arm and configured to move among a first position where the touch roller is pushed onto the forward driving roller, a second position where the touch roller is pushed onto the reverse driving roller with one of a small force and a large force, and a third position where the touch roller is spaced from both the forward driving roller and the reverse driving roller;

wherein when the touch roller is pushed onto the reverse driving roller with the small force the reverse driving roller functions as a reverse roller, and when the touch roller is pushed onto the reverse driving roller with the large force the reverse driving roller functions as a tension roller.

2. The band-applying apparatus according to claim 1, wherein the changeover mechanism comprises a cam and rotates the support arm in accordance with positional changes of the cam.

3. The band-applying apparatus according to claim 2, wherein the cam is mounted on a camshaft for driving a sealing unit which is provided in the packing system, said sealing unit being provided to hold a distal end of the band, adhere ends of the band and cut the band.

4. A band-applying apparatus for use in a packing system, said band-applying apparatus comprising:

a forward driving roller configured to rotate in a first direction to feed a band in a prescribed direction;

a reverse driving roller spaced apart from the forward driving roller and configured to rotate in a second direction opposite to the first direction;

a support arm configured to be rotated;

a changeover mechanism for rotating the support arm to change an inclination of the support arm; and a touch roller mounted on a free end of the support arm and configured to move among a first position where the touch roller is pushed onto the forward driving roller, a second position where the touch roller is pushed onto the reverse driving roller with one of a small force and a large force, and a third position where the touch roller is spaced from both the forward driving roller and the reverse driving roller;

wherein the changeover mechanism comprises:

a cam mounted on a camshaft for driving a sealing unit which is provided in the packing system, said sealing unit being provided to hold a distal end of the band, adhere ends of the band and cut the band, and said cam being configured to rotate as the camshaft rotates;

a swing arm which is pushed onto the cam by a cam support spring and which is configured to rotate as a position of the cam changes; and a support rod holding the support arm and configured to rotate the support arm by transmitting rotation of the swing arm to the support arm, and wherein said changeover mechanism rotates the support arm as the swing arm rotates in accordance with the position of the cam, in order to change the direction in which the support arm rotates in accordance with the position of the cam, and to push the touch roller onto one of the forward driving roller and the reverse driving roller, and change the force with which the touch roller is pushed onto the reverse driving roller, in accordance with the position of the cam.

5. The band-applying apparatus according to claim 4, wherein the changeover mechanism further comprises a cam roller mounted on the swing arm and configured to be pushed onto the cam by a bias of the cam support spring.

6. The band-applying apparatus according to claim 5, wherein the changeover mechanism further comprises first and second pushing members configured to contact a proximal end of the support arm and transmit motion of the support rod to the support arm, said first pushing member being configured to slide in an axis of the support rod, and wherein a force-adjusting spring is mounted on the support rod and biases the first pushing member, thereby to change the force with which the touch roller is pushed onto the reverse driving roller, in accordance with a displacement of the support rod with respect to the proximal end of the support arm.

* * * * *